US010882730B2

(12) United States Patent
Lambrecht et al.

(10) Patent No.: US 10,882,730 B2
(45) Date of Patent: Jan. 5, 2021

(54) METHOD AND APPARATUS FOR BEVERAGE DISPENSING INCLUDING CONTAINER STOPPER

(71) Applicant: Coravin, Inc., Burlington, MA (US)

(72) Inventors: Gregory Lambrecht, Natick, MA (US); Michael Rider, Lowell, MA (US); Andrew S. Sweezey, Malden, MA (US); Otto DeRuntz, Dunstable, MA (US)

(73) Assignee: Coravin, Inc., Bedford, MA (US)

( * ) Notice: Subject to any disclaimer, the term of this patent is extended or adjusted under 35 U.S.C. 154(b) by 0 days.

(21) Appl. No.: 16/449,513

(22) Filed: Jun. 24, 2019

(65) Prior Publication Data

US 2019/0389715 A1 Dec. 26, 2019

Related U.S. Application Data

(60) Provisional application No. 62/689,263, filed on Jun. 25, 2018.

(51) Int. Cl.
*B67D 3/00* (2006.01)

(52) U.S. Cl.
CPC ..... *B67D 3/0051* (2013.01); *B67D 3/0016* (2013.01)

(58) Field of Classification Search
CPC .. B67D 3/0051; B67D 3/0016; B67D 1/0418; B67D 1/0885; B67D 1/04; B67D 1/0412; B65D 81/2053; B65D 81/24; B65D 81/3876
USPC ..... 222/400.7, 399, 394, 397, 401
See application file for complete search history.

(56) References Cited

U.S. PATENT DOCUMENTS

| | | | | |
|---|---|---|---|---|
| 4,475,576 | A | 10/1984 | Simon | |
| 4,763,803 | A | 8/1988 | Schneider | |
| 5,040,703 | A * | 8/1991 | Roark | B67D 1/0406 222/173 |
| 5,172,821 | A | 12/1992 | Knopf | |
| 7,726,355 | B2 | 6/2010 | Lemme et al. | |
| 8,276,625 | B2 | 10/2012 | Dulst | |
| 8,919,610 | B2 | 12/2014 | Haley et al. | |

(Continued)

FOREIGN PATENT DOCUMENTS

| | | |
|---|---|---|
| FR | 2 739 840 A1 | 4/1997 |
| WO | WO 2011/010616 A1 | 1/2011 |

(Continued)

OTHER PUBLICATIONS

Invitation to Pay Additional Fees for International Application No. PCT/US2019/038679, dated Sep. 11, 2019.

(Continued)

*Primary Examiner* — Lien M Ngo
(74) *Attorney, Agent, or Firm* — Wolf, Greenfield & Sacks, P.C.

(57) ABSTRACT

A system and method for dispensing sparkling and other non-pressurized beverages from a container. Sparkling wine and other beverages may be dispensed using a dispensing system that includes a stopper body that can be engaged with the container at the container opening. The stopper body may be arranged to introduce gas into the container during pouring-type dispensing, as well as re-pressurize and seal the container for storage, e.g., to keep a carbonation level of beverage remaining in the container.

24 Claims, 5 Drawing Sheets

(56) References Cited

U.S. PATENT DOCUMENTS

| | | | | |
|---|---|---|---|---|
| 9,051,092 | B1 * | 6/2015 | Monbarren | B65D 41/0428 |
| 9,284,177 | B2 * | 3/2016 | Litto | B67D 1/12 |
| 9,758,362 | B2 * | 9/2017 | Rider | B67D 1/0412 |
| 10,160,560 | B2 * | 12/2018 | Schovain | B65B 31/047 |
| 2009/0188885 | A1 * | 7/2009 | Nichols | B65D 23/106 215/272 |
| 2010/0012612 | A1 | 1/2010 | Miyanaga | |
| 2010/0160560 | A1 | 1/2010 | Lee et al. | |
| 2010/0028515 | A1 | 2/2010 | Gormley | |
| 2015/0266713 | A1 * | 9/2015 | Peirsman | B67D 1/0841 222/394 |
| 2017/0002980 | A1 * | 1/2017 | Rider | F17C 5/06 |
| 2018/0257841 | A1 | 9/2018 | Jüni | |
| 2019/0039785 | A1 * | 2/2019 | Gormley | B65D 39/0035 |

FOREIGN PATENT DOCUMENTS

| | | | |
|---|---|---|---|
| WO | WO 2013/162373 | A1 | 10/2013 |
| WO | WO 2014/152721 | A1 | 9/2014 |
| WO | WO 2018/195225 | A1 | 10/2018 |

OTHER PUBLICATIONS

PCT/US2019/038679, Nov. 5, 2019, International Search Report and Written Opinion.
International Search Report and Written Opinion for International Application No. PCT/US2019/038679, dated Nov. 5, 2019.

* cited by examiner

METHOD AND APPARATUS FOR BEVERAGE DISPENSING INCLUDING CONTAINER STOPPER

RELATED APPLICATION

This Application claims priority under 35 U.S.C. § 119(e) to U.S. Provisional Application Ser. No. 62/689,263, entitled "METHOD AND APPARATUS FOR BEVERAGE DISPENSING INCLUDING CONTAINER STOPPER" filed Jun. 25, 2018, which is herein incorporated by reference in its entirety.

BACKGROUND OF INVENTION

This invention relates generally to the dispensing or other extraction of fluids from within a container, e.g., in the dispensing of sparkling wine from a wine bottle.

SUMMARY OF INVENTION

One or more embodiments in accordance with aspects of the invention allow a user to withdraw or otherwise dispense a beverage, such as wine, from within a bottle or other container. In some cases, dispensing of liquid from such a bottle may be performed one or more times, and a stopper may remain in place during and after each beverage dispensing to maintain a seal for the bottle. Thus, the beverage may be dispensed from the bottle multiple times and stored for extended periods between each dispensing with little or no effect on beverage quality. In some embodiments, little or no gas, such as air, which is reactive with the beverage, may be introduced into the bottle either during or after dispensing of beverage from within the bottle. Thus, in some embodiments, a user may dispense wine from a wine bottle without allowing air or other potentially damaging gasses or liquids entry into the bottle. In some embodiments, a pressure above ambient pressure may be maintained in the bottle after dispensing is complete, which may help maintain a carbonation level in a sparkling beverage.

In one aspect of the invention, a system is provided for dispensing a beverage from a container having a neck, an opening at the neck to access an internal volume of the container, and a lip on an outer surface of the neck. The system may include a stopper body having a lower surface arranged to contact and form a seal with a portion of the neck around the opening, a dispensing pathway extending through the stopper body from a lower portion to an upper portion of the stopper body, and a gas inlet pathway extending from a gas inlet port to the lower portion of the stopper body. A cap may be arranged to seal the dispensing pathway at the upper portion of the stopper body, with the cap being movable between an open position in which the dispensing pathway is open to dispense beverage from the container and a closed position in which the dispensing pathway is closed. A lip engagement member may be adapted to engage with the lip on the neck and to engage with the stopper body to exert a force on the stopper body to urge the lower surface into contact with the portion of the neck around the opening. As a result, the lower surface may establish a fluid-tight seal with the container at an area around the container opening. In some cases, the lower surface is arranged to contact and form a seal with an uppermost portion of the neck around the opening. The dispensing pathway and the gas inlet pathway may extend from an area of the lower portion of the stopper body that is radially within the lower surface, i.e., so that the gas inlet pathway and dispensing pathway may communicate with the internal volume of the container when the stopper body is secured to the container. In some cases, the gas inlet pathway may extend below a lowermost part of the dispensing pathway, e.g., so that gas introduced into the container during dispensing does not exit with beverage being dispensed.

In some embodiments, the lip engagement member is adapted to threadedly engage with the stopper body such that rotation of the stopper body relative to the lip engagement member moves the stopper body toward the lip engagement member to urge the lower surface into contact with the portion of the neck. Thus, for example, the stopper body may be screwed relative to the lip engagement member to tighten the stopper body onto the container opening. In some cases, the lip engagement member has a U-shaped portion adapted to receive a part of the neck below the lip. For example, the U-shaped portion may be slid over the neck at a location below the lip so that the U-shaped portion cannot be moved upwardly relative to the container past the lip.

The gas inlet port may be located on a sidewall of the stopper body, and may be arranged to fluidly couple with a gas supply adapted to provide pressurized gas to the gas inlet pathway. The gas supply may be arranged in a variety of ways, and may include a normally-closed valve that is opened by fluid coupling of the gas supply to the gas inlet port. Thus, when the gas supply is connected to the gas inlet port, the gas supply may begin delivering gas. In other arrangements, the gas supply may include a user operated valve that can be manipulated by a user to start and stop gas flow. In some cases, the gas supply may include a pressurized gas cartridge and the gas supply and the stopper body are adapted to pressurize the internal volume of the container to at least 10 psi (e.g., adapted to pressurize and maintain pressure at 30-50 psi). This may be useful to help maintain beverage carbonation during extended storage. The gas supply may include a regulator to adjust a pressure of pressurized gas provided to the gas inlet. For example, the regulator may adjust the pressure from a gas cartridge provided at 1000 to 3000 psi down to 20-50 psi for delivery to the container. In some cases the gas supply may be arranged to provide gas at two different pressures or flow rates. One pressure/flow rate may be used to introduce gas into the container while beverage is poured from the stopper body dispensing pathway, and another pressure/flow rate may be used to establish a storage pressure in the container to help maintain carbonation during more extended storage of 1 hour, 1 day or more. The gas inlet pathway may include a one-way valve that permits flow in the gas inlet pathway from the gas inlet port to the lower portion of the stopper body, and resists flow from the lower portion of the stopper body to the gas inlet port. This may allow the gas supply to be decoupled from the gas inlet port while maintaining pressure in the container.

The cap used to close the beverage dispensing pathway of the stopper body may be configured in different ways, including as a valve secured to the stopper body. In one embodiment, the cap is attached to the stopper body by a hinge that allows the cap to be moved between open and closed positions relative to the dispensing pathway. In some cases, the movement of the cap via the hinge is damped, e.g., so that the cap cannot move rapidly while opening the cap with the container under pressure. A detent may be arranged to hold the cap in an open position and/or a closed position relative to the stopper body. This may help keep the cap from flopping around while the container and stopper body are manipulated during dispensing.

In some embodiments, the cap is adapted to produce a sound that simulates a cork popping from a sparkling wine bottle when the cap moves from the closed position to the open position. The cap may produce a "pop" sound when the container is pressurized during cap opening, or even if the container is not pressurized.

In some cases, the stopper body and the cap are adapted to seal the opening of the container closed and maintain a pressure in the internal volume of the container above at least 10 psi (e.g., 30-50 psi) for 1 hour, 1 day, 1 week, 1 month or more. This can allow the stopper body and cap to allow storage of a sparkling beverage for an extended period while maintaining a desired carbonation level.

In another aspect of the invention, a system for dispensing a beverage includes a stopper body having a lower surface arranged to contact and form a seal with a portion of a container neck around the opening, a dispensing pathway extending through the stopper body from a lower portion to an upper portion of the stopper body, and a gas inlet pathway extending from a gas inlet port to the lower portion of the stopper body. A cap may be arranged to seal the dispensing pathway at the upper portion of the stopper body. A sleeve may be adapted to receive the container in an inner space of the sleeve (e.g., so the sleeve covers at least a portion of the container) and to engage with the stopper body and exert a force on the stopper body to urge the lower surface into contact with the portion of the neck around the opening. That is, the sleeve and stopper body may be arranged so that the stopper body cannot be secured to a container unless the stopper body interacts with at least a portion of the sleeve. This may help ensure placement of the container in the sleeve when using a stopper body to dispense beverage from the container. That is, the sleeve may be arranged to help resist breakage of a bottle, e.g., the sleeve may be adapted to cover the container and hold a broken glass container in the inner space. By helping ensure use of a sleeve with the dispensing system, breakage or other damage to the container can be resisted.

In one embodiment, the sleeve may include a lip engagement member adapted to engage with the lip on the neck and to engage with the stopper body and exert a force on the stopper body to urge the lower surface into contact with the portion of the neck around the opening. For example, the lip engagement member may include a U-shaped portion adapted to receive a part of the neck below the lip, and the lip engagement member may be adapted to threadedly engage with the stopper body such that rotation of the stopper body relative to the lip engagement member moves the stopper body and U-shaped portion towards each other. Other configurations are possible though, e.g., the sleeve may include at least one clamp arranged to engage with the stopper body and with the lip to urge the stopper body toward the lip. The one or more clamps may include a lever having a lip engagement end adapted to engage with the lip and a handle end adapted to be gripped by hand and moved to urge the stopper body toward the lip. A connecting link may be pivotally attached to the lever between the handle end and the lip engagement end and adapted to attach the lever to the stopper body.

In another aspect of the invention, a system for dispensing a beverage includes a stopper body having a lower surface arranged to contact and form a seal with a portion of the neck around the opening, a dispensing pathway extending through the stopper body from a lower portion to an upper portion of the stopper body, and a gas inlet pathway extending from a gas inlet port to the lower portion of the stopper body. A cap may be arranged to seal the dispensing pathway at the upper portion of the stopper body, and a sleeve may be adapted to receive the container in an inner space of the sleeve and to engage with the stopper body to enable the stopper body to seal and hold an above-ambient pressure in the internal volume of the container. Again, such an arrangement may help encourage use of a sleeve with a container during dispensing. In one embodiment, the sleeve may include a vent cap arranged to close a vent on the stopper body. Thus, the stopper body may have a vent that prevents establishment of a relatively high pressure in a container unless the vent is closed. By providing the vent cap with the sleeve, a user may be encouraged to use the sleeve during dispensing.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

In one aspect of the invention, a method and apparatus are provided to access sparkling wine or other beverage in a bottle or other container. Moreover, the sparkling beverage may be accessed from the container and remaining beverage stored in the bottle under pressure to maintain a desired carbonation level. That is, in some cases, only a portion of the sparkling beverage may be dispensed from the container, and the container resealed under pressure to maintain carbonation. It should be noted though that beverage dispensing systems described may be used with non-sparkling beverages, e.g., because the system allows for dispensing with little or no introduction of ambient air into a beverage container during and after dispensing.

Figure 1:
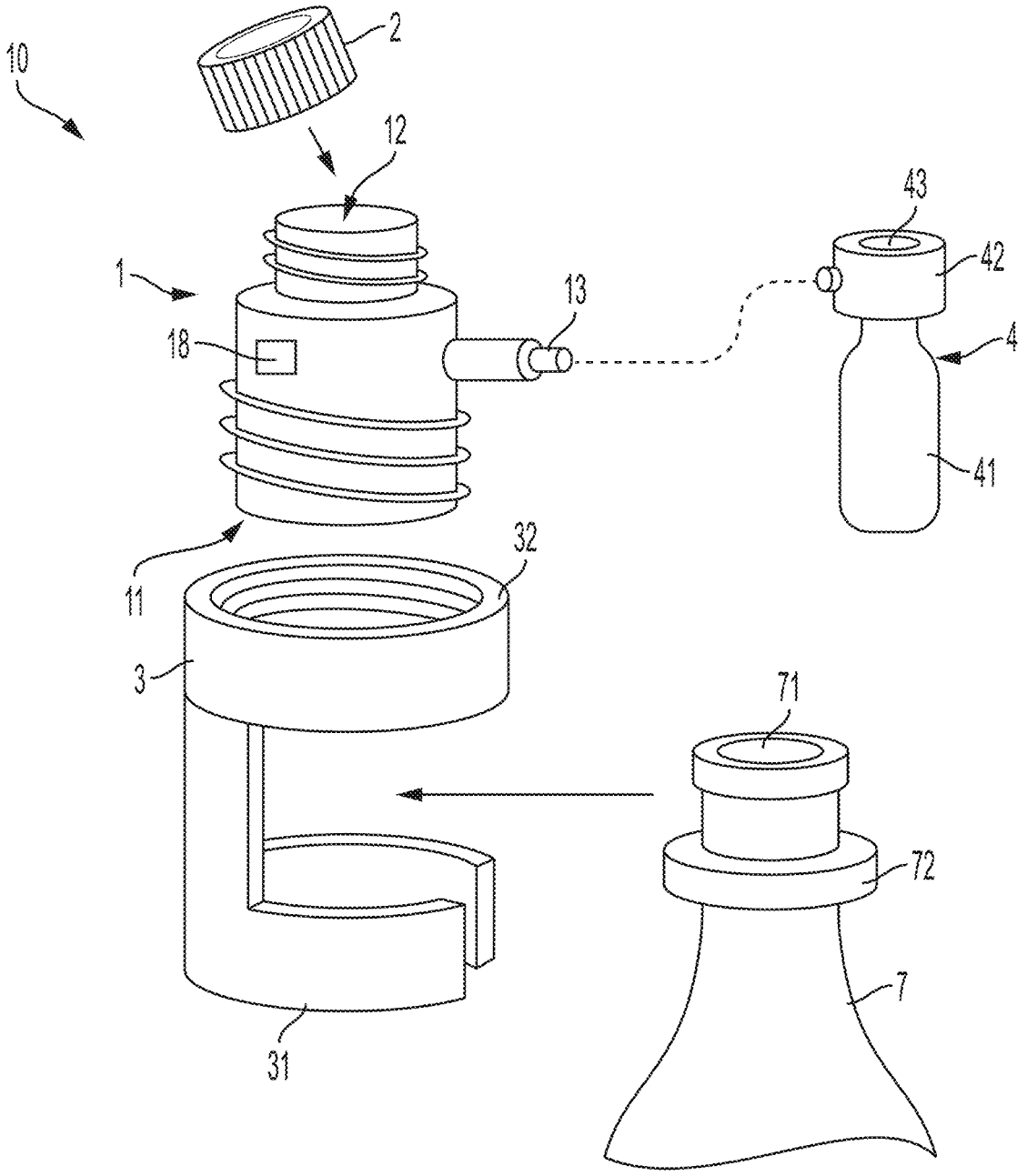
FIG. 1 shows a perspective view of a beverage dispensing system in an illustrative embodiment.

FIG. 1 shows a system 10 for dispensing a beverage from a container 7, such as a sparkling beverage from a container 7 that initially has a cork or other closure that seals an opening 71 of the container. As is the case with many sparkling wine bottles, the neck of the container includes a lip 72 below the opening 71 that is used to engage with a metal cap and wire retainer or other component that helps keep the cork or other closure in the opening 71. With the cork retainer and the cork or other closure removed, the opening 71 of the container 7 is open for dispensing beverage. In accordance with an aspect of the invention, a stopper body 1 may be engaged with the container 7 to seal the opening 71 closed as well as to allow dispensing through the stopper body. The stopper body 1 may be engaged with the container 7 using a lip engagement member 3 that engages the lip 72. Various configurations for the lip engagement member 3 are possible, but in this illustrative embodiment the lip engagement member 3 includes a U-shaped portion 31 that is sized and shaped to receive a portion of the neck of the container 7 below the lip 72 and to engage with the lip 72 as the lip engagement member 3 is moved upwardly relative to the neck. (In some embodiments, the U-shaped portion 31 may be formed as a hinged collar so that portions of the collar can be positioned completely or partially around the neck using one or more hinges.) With the lip engagement member 3 positioned on the neck, the stopper body 1 may be engaged with the lip engagement member 3 so that a lower surface 11 of the stopper body 1 is urged into contact with a portion of the container 7 around the opening 71. In this embodiment, the lip engagement member 3 threadedly engages with the stopper body 1, i.e., a threaded hole of the lip engagement member 3 receives a threaded portion at the lower part of the stopper body 1 so that as the stopper body 1 is rotated relative to the lip engagement member 3, the stopper body 1 is moved toward the lip 72. The lip engagement member 3 can be engaged with the stopper body 1 in other ways, such as by one or more bolts or screws (e.g., in a flange-type connections), a bail and buckle fastener (e.g., like that found on ski boots), a bayonet connection, and others. Also, the lip engagement member 3 may engage the lip 72 in other ways, such as by clamping on the bottle neck.

Engagement of the lip engagement member 3 with the lip 72 and the stopper body 1 urges the lower surface 11 into contact with the container 7 at or near the opening 71 so as to form a liquid and gas tight seal with the container 7. This can allow for the introduction of pressurized gas into the container 7 from a gas source 4, e.g., via a gas inlet port 13 which can help maintain a desired carbonation level of the beverage stored in the container 7. The gas source 4 may be fluidly coupled to the gas inlet port 13 by a quick-connect type fitting, threaded fitting or other suitable engagement. Introduction of gas into the container 7 can also allow dispensing of the beverage through a dispensing pathway 12. For example, with a cap 2 removed from the stopper body 1, the dispensing pathway 12 may be opened to allow dispensing of beverage through the stopper body 1. That is, with the cap 2 removed, a user may tilt the container 7 to pour beverage from the dispensing opening 12. Gas may be introduced into the container from the gas source 4 via the gas inlet port 13 and a gas inlet pathway through the stopper body 1, whether to enable dispensing or to re-pressurized a container for storage. (As will be appreciated, pressurization of a container requires the cap 2 to be secured in the closed position to seal the dispensing pathway 12 closed.) The gas source 4 may include a pressurized gas container, such as a gas cylinder that holds a suitable gas (carbon dioxide, nitrogen, argon, etc.) under relatively high pressure such as 100-3000 psi. The gas source 4 may include a pressure regulator, which may include a regulating valve or valves, a flow restrictor such as a restriction orifice, and/or other arrangement to control a gas flow rate and/or pressure provided to the gas inlet port 13. Alternately or in addition, such features may be provided with the stopper body 1. The gas source 4 may also include a valve 43 that can be operated by a user to control the flow of gas. For example, a user can press a button of the valve 43 to cause gas to flow into the container 7, and release the button to stop gas flow. The gas source 4 may provide gas at two or more selectable pressures and/or flow rates, if desired. For example, gas may be provided at a first pressure and first flow rate while beverage is poured from the container 7 through the dispensing pathway 12. When dispensing is complete, the cap 2 may be put in the closed position on the stopper body 1 to seal the dispensing pathway 12 closed. In this embodiment, the cap 2 threadedly engages the stopper body 1 to seal the dispensing pathway 12 closed against gas and/or liquid flow, but other arrangements are possible such as a hinged connection for the cap 2 to the body 1. Thereafter, the gas source 4 may be used to introduce gas at a second pressure and/or second flow rate into the container. The second pressure and/or flow rate may be different from the first pressure and/or flow rate, e.g., the second pressure may be higher than the first pressure and the second flow rate may be lower than the first pressure. This second pressure and flow rate may be suitable to maintain a storage pressure in the container 7 to help maintain a desired carbonation level in the container 7. Since the stopper body 1 may seal the opening 71 of the container closed, an above-ambient pressure may be maintained in the container 7 internal volume for an extended period, such as 1 day, 1 week, 1 month or more. The gas inlet port 13 or other portion of the gas inlet pathway may include a check valve or other one-way valve that allows gas flow into the container 7 but resists gas flow out of the container 7. In addition or alternately, the gas inlet port 13 may be capped or otherwise closed to prevent pressure leakage.

Figure 2:
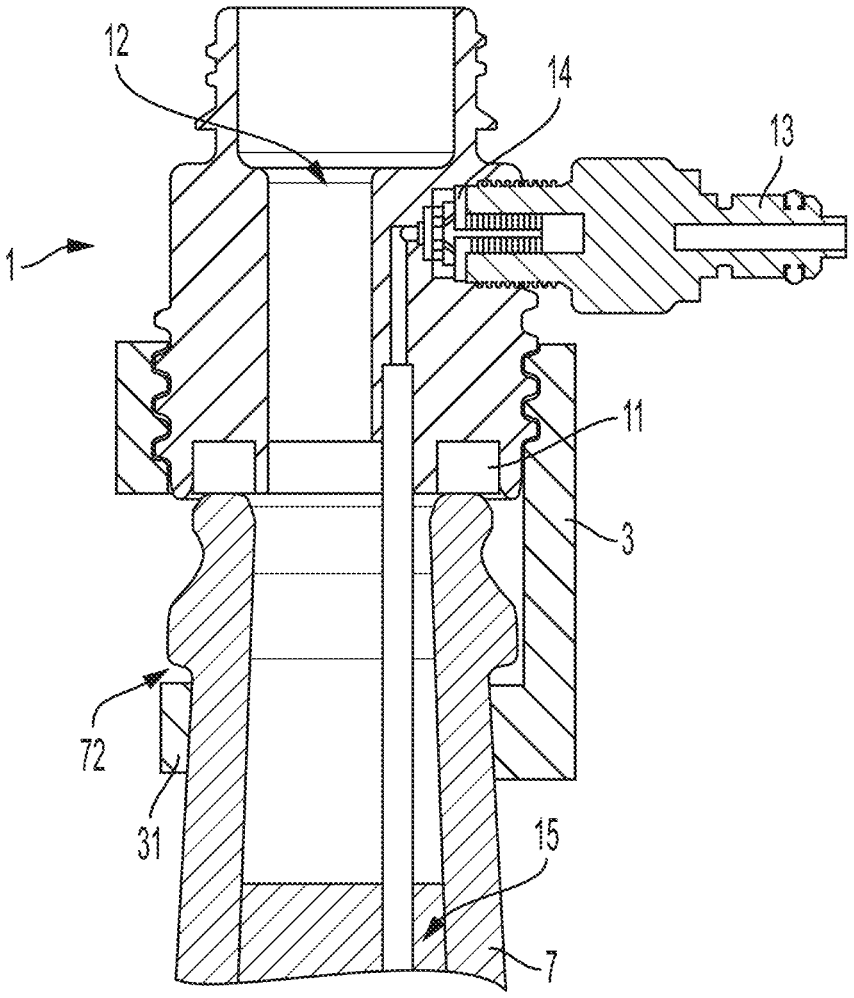
FIG. 2 shows a cross sectional view of the stopper body and lip engagement member in the FIG. 1 embodiment.

FIG. 2 shows a cross sectional view of the FIG. 1 embodiment and illustrates the system 10 where the stopper body 1 is urged into engagement with the container 7 so that a lower surface 11 of the body 1 forms a seal with the container 7 near the opening 71. In this embodiment, the lower surface 11 includes a gasket, which may include a resilient or elastomeric rubber or other suitable component. In this embodiment, the lower surface 11 forms a seal with an uppermost portion of the container 7 around the opening 71 by pressing downwardly on the container 7. (It will be appreciated that the terms upward, upper, downward, lowermost, etc. are for ease of reference and do not require any particular positioning or orientation with respect to gravity.) The lower surface 11 may present a generally planar sealing surface to the container 7 and engage portions of the container 7 above the lip 72. This may help the body 1 form a seal with a variety of differently shaped and sized openings 71. However, in other embodiments, the stopper body 1 may form a seal with other portions of the container 7, such as an inner surface of the container 7 below the opening 71. As can also be seen in FIG. 2, the lip engagement member 3 contacts a lower part of the lip 72 so that the lip engagement member 72 can pull the stopper body 1 toward the lip 72 and into engagement with the container 7 near the opening 71. FIG. 2 also shows a check valve or other one-way valve 14 for the gas inlet pathway 15. In this embodiment, the gas inlet pathway 15 includes a conduit that extends below the lower surface 11 of the stopper body 1 and into the internal volume of the container 7. This may help introduce gas into the container 7 during dispensing while avoiding having the gas entrained into the beverage flow through the dispensing pathway 12 and out of the container 7. That is, to dispense beverage from a stopper body 1 secured to the container 7, the container 7 is tipped or tilted in a way like that normally done to pour a beverage from a bottle. This causes the beverage to flow toward the opening 71 and to flow out of the container though the dispensing pathway 12 which extends from a lower portion of the stopper body 1 to an upper portion of the stopper body 1. As is known in the art, to allow beverage to exit the container 7, gas must be somehow provided into the internal volume of the container 7 or flow out of the container 7 will stop. The gas source 4 and gas inlet pathway 15 can be used to introduce gas to allow for pouring-type dispensing through the dispensing pathway 12 and the gas flow may be regulated in pressure and/or flow rate to provide a suitable dispensing rate. By introducing gas into the container 7 during dispensing from the gas source 4, exposure of beverage in the container 7 to air may be reduced, thereby helping to maintain proper taste for the beverage. Also, the gas from the gas source 4 may help allow the beverage to be stored for longer periods while minimizing exposure to potentially damaging air.

Moreover, the gas flow and features of the dispensing pathway 12 may be arranged to provide a relatively smooth and non-turbulent flow of beverage that helps maintain a carbonation level of the beverage dispensed. For example, the distal end of the gas inlet pathway 15 may be flared, enlarged in cross sectional area or otherwise arranged to reduce a velocity of gas introduced into the container 7. This may help reduce any disturbance of beverage during dispensing, e.g., that may be caused by gas jetting into the beverage and resulting in dissolved gas bubble nucleation and growth. In other arrangements, the gas inlet pathway 15 may include a sparging element or other component that helps introduce gas into the beverage in a gentle way. The dispensing pathway 12 may be arranged to reduce turbulence and otherwise help keep dissolved gas in the dispensed beverage, including being sized and shaped to achieve suitable flow, having a smooth surface finish, having as large a diameter and as short a length as possible, and minimizing obstructions and sharp edges in the beverage flow path.

As shown schematically in FIG. 1, the dispensing system 10 may include a user interface 18 to provide information to a user and/or to receive input from a user. As an example, the user interface 18 may include a pressure indicator that indicates a pressure in the internal volume of the container 7 (e.g., during storage). The pressure indicator may indicate an actual pressure in the internal volume above ambient (e.g., "24 psi"), or may indicate whether the pressure in the internal volume is above a particular threshold (e.g., a mechanical flag or other element may move or reveal a visible indicator to show that pressure in the container is above a threshold needed to maintain suitable carbonation. Other information may be indicated by a user interface 18. For example, the user interface 18 may indicate a temperature of beverage in the container 7, a remaining volume of beverage in the container 7, etc. In another embodiment, the user interface 18 may include a thermochromic ink or other element that changes color to indicate a temperature of beverage in the container 7.

Figure 3:
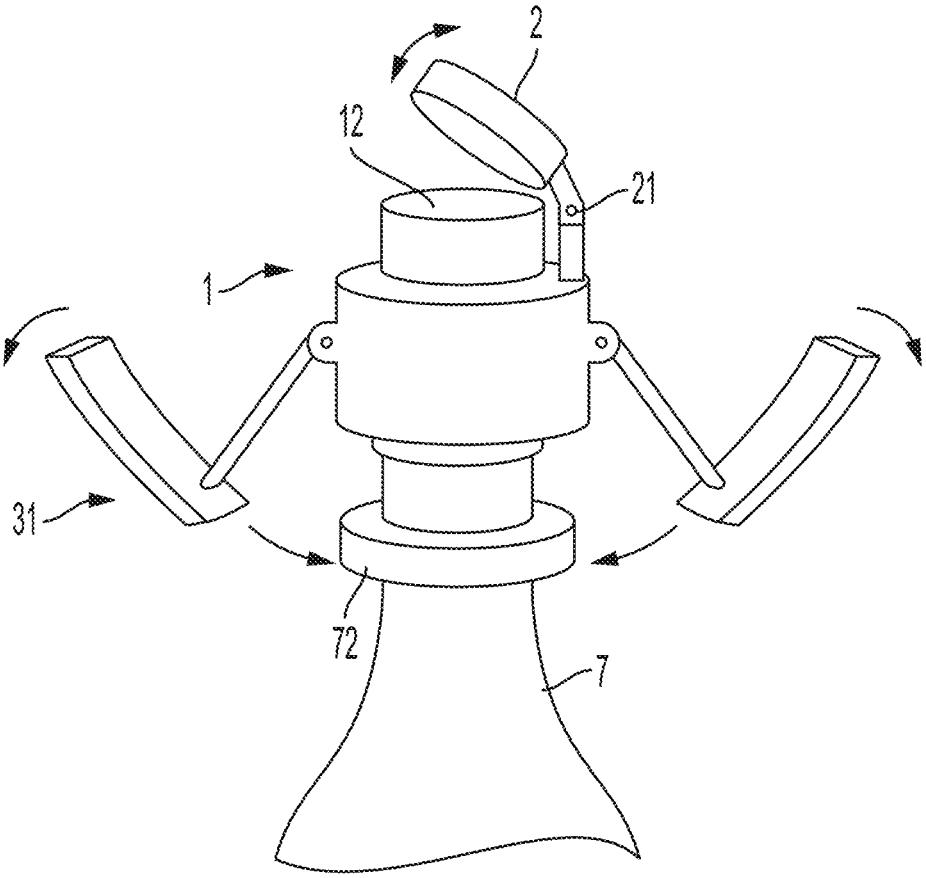
FIG. 3 shows another illustrative embodiment of a beverage dispensing system including a lever arrangement to engage a container lip.

As noted above, the dispensing system 10 may engage with a container 7 in other ways, and FIG. 3 shows one alternate embodiment, though others are possible. In this embodiment, the lip engaging member 3 includes a pair of levers arranged to engage with the lip 72 of the container 7 to urge the stopper body 1 into contact with the container 7 near the opening 71. The levers include a lip engaging end opposite a handle end, and a connecting link is pivotally connected to the levers between the lip engaging end and the handle end. The connecting links secure the levers to the stopper body 1 so that the lip engaging ends of the levers can be positioned under the lip 72 and the handle ends of the levers pushed downwardly. This causes the connecting links to pull the body 1 downwardly, engaging the lower surface 11 with the container 7 at the opening 71. The levers can be pushed downwardly until the levers contact the container 7 and lock the stopper body 1 in place.

FIG. 3 also shows an alternate arrangement for the cap 2 used to open and close the dispensing pathway 12. In this embodiment, the cap 2 is mounted to the stopper body 1 by a hinge 21 that allows the cap 2 to be pivoted between open and closed positions relative to the dispensing pathway 12. The cap 2 may be secured in the closed position to seal the dispensing pathway 12 closed by a latch, bail, clip or other feature, and a seal between the cap 2 and the body 1 may be provided by an elastomeric gasket or other element. The hinge 21 may include a detent that secures the cap 2 in the open and/or closed positions. The detent feature may help keep the cap in the open position during dispensing so that the cap 2 does not interfere with pouring. For example, tilting of the container 7 and body 1 during dispensing may cause the cap 2 to move. However, the detent may help keep the cap 2 in the open position during dispensing. Similarly, the detent may help keep the cap 2 in the closed position, e.g., so the cap 2 does not move to the open position during handling of the container 7. The hinge 21 may also provide for damped movement of the cap 2 relative to the stopper body 1. For example, the container 7 may be stored with a relatively high internal pressure and when the cap 2 is moved from the closed to the open position for dispensing, the internal pressure may tend to forcibly push the cap 2 to the open position. The hinge 21 may damp the movement of the cap 2 so that the cap 2 cannot move rapidly to the open position, but rather move relatively slowly despite the internal pressure assisting in the cap's movement.

In another aspect of the invention, the cap 2 and stopper body 1 may be adapted to produce a sound that mimics the sound produced when a sparkling wine cork is rapidly removed from a bottle (e.g., to reproduce a "pop" sound). The cap 2 and body 1 may be arranged to produce a "pop" sound each time the cap is moved from the closed to the open position, including whether the stopper body 1 is secured to a pressurized container 7 or not. Alternately, the cap 2 and body 1 may be arranged to produce a "pop" sound only when the body 1 is secured to a pressurized container 7. This feature may help users enjoy the ambiance of opening a new sparkling wine bottle, even with a bottle that has been poured from before.

In some aspects of the invention, a dispensing system may be arranged to operate only with a sleeve that is placed around the container. For example, although the beverage dispensing system can be used with non-carbonated or non-sparkling beverages, containers that hold sparkling beverages are generally stored under relatively high internal pressures prior to opening. Such containers are often made of glass, and if the container is damaged or strikes an object, the glass container may break and internal pressure may cause glass pieces to be pushed outwardly, away from the container. A sleeve may be positioned around at least a portion of the container and thus help protect against possible injury. With a dispensing system arranged to operate with a sleeve, the system may provide some protection against possible injury that may occur in unusual circumstances.

Figure 4:
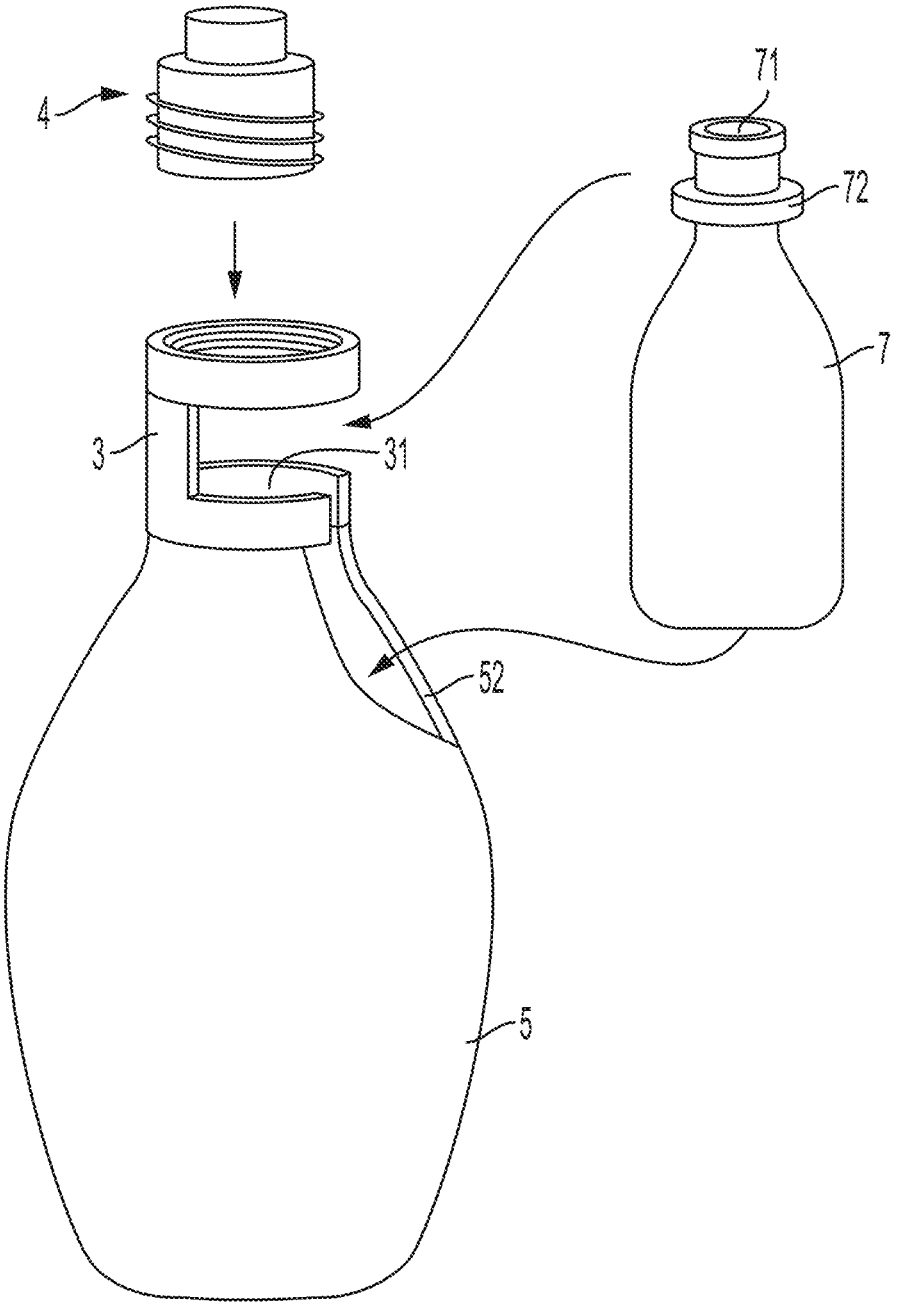
FIG. 4 shows a beverage dispensing system similar to that in FIG. 1 and having a container sleeve attached to the lip engagement member.
Figure 5:
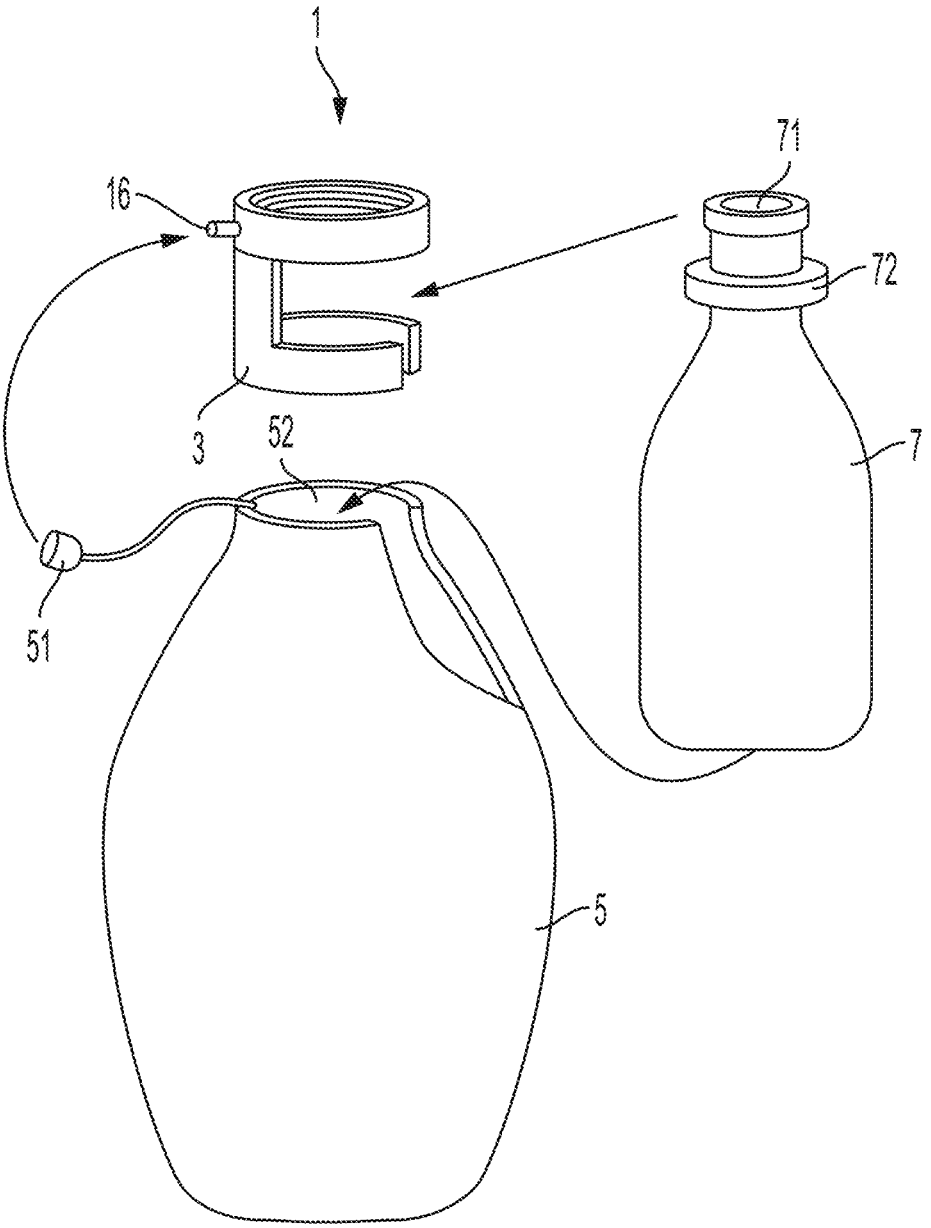
FIG. 5 shows another illustrative embodiment of a beverage dispensing system including a sleeve with an attached vent cap arranged to close a vent pathway on the stopper body.

In one embodiment, a lip engagement member of a dispensing system may be attached to a sleeve so that a stopper body cannot be secured to a container without the sleeve being present. As an example, FIG. 4 shows an embodiment in which the lip engagement member 3 is attached to a sleeve 5 arranged to receive a container 7 via an opening 52 so that the sleeve 5 at least partially covers the container 7. The sleeve 5 may be made in different ways, such as a bag made of a flexible fabric that is suitably robust to resist cutting by sharp glass, an enclosure made of a rigid plastic or metal that holds the container 7 in an inner space of the sleeve 5, and others. Since the sleeve 5 is attached to the lip engagement member 3, the stopper body 1 cannot be secured to a container 7 without the sleeve 5 being present. This may help encourage a user to place the container 7 in the sleeve 5 prior to dispensing with the stopper body 1. FIG. 5 shows an alternative embodiment in which a vent cap 51 is secured to a sleeve 5. In this embodiment, the stopper body 1 and lip engagement member 3 are made as in FIG. 1, but in contrast to the FIG. 1 embodiment, the stopper body 1 includes a vent 16 with a vent pathway through the body 1 that communicates with the dispensing pathway 12. The vent 16 thus prevents the establishment and maintaining of a high pressure in the container 7 unless the vent cap 51 is secured to the vent 16. Again, since the vent cap 51 is secured to the sleeve 5, a user will be encouraged to place the container 7 in the sleeve 5 prior to dispensing using the system 10.

The sleeve 5 can have various optional features. For example, the sleeve 5 may include padding or other impact resistant materials to help prevent breakage of a glass bottle in case the bottle is dropped while located in the sleeve. Another option is to provide the sleeve 5 with thermal insulation to help keep a chilled beverage cold. The sleeve 5 may be made of a mesh, transparent or other material that allows for viewing of at least a portion of the container 7. For example, the sleeve 5 may include a transparent or mesh window that allows viewing of the bottle label. The sleeve 5 may include a thermochromic ink or other portion that adopts a color indicative of the temperature of the bottle within the sleeve 5. This may help a user identify whether the container and its beverage are undesirable warming, prompting the user to place the container in an ice bath, refrigerator or take other action.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A system for dispensing a beverage from a container having a neck, an opening at the neck to access an internal volume of the container, and a lip on an outer surface of the neck, the system comprising:

a stopper body having a lower surface arranged to contact and form a seal with a portion of the neck around the opening, a dispensing pathway extending through the stopper body from a lower portion to an upper portion of the stopper body, and a gas inlet pathway extending from a gas inlet port to the lower portion of the stopper body;

a cap arranged to seal the dispensing pathway at the upper portion of the stopper body, the cap being movable between an open position in which the dispensing pathway is open to dispense beverage from the container and a closed position in which the dispensing pathway is closed, wherein the cap is adapted to produce a sound that simulates a cork popping from a sparkling wine bottle when the cap moves from the closed position to the open position; and a lip engagement member adapted to engage with the lip on the neck and to engage with the stopper body and exert a force on the stopper body to urge the lower surface into contact with the portion of the neck around the opening.

2. The system of claim 1, wherein the lower surface is arranged to contact and form a seal with an uppermost portion of the neck around the opening.

3. The system of claim 1, wherein the lip engagement member is non-removably attached to a sleeve adapted to receive the container in an inner space of the sleeve.

4. The system of claim 1, wherein the lip engagement member is adapted to threadedly engage with the stopper body such that rotation of the stopper body relative to the lip engagement member moves the stopper body toward the lip engagement member to urge the lower surface into contact with the portion of the neck.

5. The system of claim 1, wherein the lip engagement member has a U-shaped portion adapted to receive a part of the neck below the lip.

6. The system of claim 1, wherein the dispensing pathway and the gas inlet pathway extend from an area of the lower portion of the stopper body that is radially within the lower surface.

7. The system of claim 1, further comprising a gas supply adapted to fluidly couple to the gas inlet port and provide pressurized gas to the gas inlet pathway.

8. The system of claim 7, wherein the gas supply includes a pressurized gas cartridge and the gas supply and the stopper body are adapted to pressurize the internal volume of the container to at least 10 psi.

9. A system for dispensing a beverage from a container having a neck, an opening at the neck to access an internal volume of the container, and a lip on an outer surface of the neck, the system comprising:

a stopper body having a lower surface arranged to contact and form a seal with a portion of the neck around the opening, a dispensing pathway extending through the stopper body from a lower portion to an upper portion of the stopper body, and a gas inlet pathway extending from a gas inlet port to the lower portion of the stopper body;

a cap arranged to seal the dispensing pathway at the upper portion of the stopper body, the cap being movable between an open position in which the dispensing pathway is open to dispense beverage from the container and a closed position in which the dispensing pathway is closed, wherein the cap is attached to the stopper body by a hinge that allows the cap to be moved between open and closed positions relative to the dispensing pathway; and a lip engagement member adapted to engage with the lip on the neck and to engage with the stopper body and exert a force on the stopper body to urge the lower surface into contact with the portion of the neck around the opening.

10. The system of claim 9, wherein movement of the cap via the hinge is damped.

11. The system of claim 9, further comprising a detent arranged to hold the cap in an open position relative to the stopper body.

12. The system of claim 1, wherein the stopper body and the cap are adapted to seal the opening of the container closed and maintain a pressure in the internal volume of the container above at least 10 psi for 24 hours.

13. A system for dispensing a beverage from a container having a neck, an opening at the neck to access an internal volume of the container, and a lip on an outer surface of the neck, the system comprising:

a stopper body having a lower surface arranged to contact and form a seal with a portion of the neck around the opening, a dispensing pathway extending through the stopper body from a lower portion to an upper portion of the stopper body, and a gas inlet pathway extending from a gas inlet port to the lower portion of the stopper body;

a cap arranged to seal the dispensing pathway at the upper portion of the stopper body, the cap being movable between an open position in which the dispensing pathway is open to dispense beverage from the container and a closed position in which the dispensing pathway is closed;

a lip engagement member adapted to engage with the lip on the neck and to engage with the stopper body and exert a force on the stopper body to urge the lower surface into contact with the portion of the neck around the opening; and a pressure indicator attached to the stopper body to indicate a pressure in the internal volume of the container.

14. A system for dispensing a beverage from a container having a neck, an opening at the neck to access an internal volume of the container, and a lip on an outer surface of the neck, the system comprising:

a stopper body having a lower surface arranged to contact and form a seal with a portion of the neck around the opening, a dispensing pathway extending through the stopper body from a lower portion to an upper portion of the stopper body, and a gas inlet pathway extending from a gas inlet port to the lower portion of the stopper body;

a cap arranged to seal the dispensing pathway at the upper portion of the stopper body; and a sleeve adapted to receive the container in an inner space of the sleeve and to engage with the stopper body and exert a force on the stopper body to urge the lower surface into contact with the portion of the neck around the opening, wherein the sleeve is adapted to cover the container and hold a broken glass container in the inner space.

15. The system of claim 14, wherein the sleeve includes a lip engagement member adapted to engage with the lip on the neck and to engage with the stopper body and exert a force on the stopper body to urge the lower surface into contact with the portion of the neck around the opening.

16. The system of claim 15, wherein the lip engagement member includes a U-shaped portion adapted to receive a part of the neck below the lip, the lip engagement member adapted to threadedly engage with the stopper body such that rotation of the stopper body relative to the lip engagement member moves the stopper body and U-shaped portion towards each other.

17. The system of claim 14, wherein the sleeve includes at least one clamp arranged to engage with the stopper body and with the lip to urge the stopper body toward the lip.

18. The system of claim 17, wherein the at least one clamp includes a lever having a lip engagement end adapted to engage with the lip and a handle end adapted to be gripped by hand and moved to urge the stopper body toward the lip.

19. The system of claim 18, wherein the at least one clamp includes a connecting link pivotally attached to the lever between the handle end and the lip engagement end and adapted to attach the lever to the stopper body.

20. A system for storing a beverage in a container having a neck, an opening at the neck to access an internal volume of the container, and a lip on an outer surface of the neck, the system comprising:

a stopper body having a lower surface arranged to contact and form a seal with a portion of the neck around the opening, and a gas inlet pathway extending from a gas inlet port to the lower surface of the stopper body;

a lip engagement member including at least one clamp arranged to engage with the lip on the neck and to engage with the stopper body and exert a force on the stopper body to urge the lower surface into contact with the portion of the neck around the opening, wherein the at least one clamp includes a lever adapted to be gripped by hand and moved to urge the stopper body toward the lip; and a sleeve adapted to receive the container in an inner space of the sleeve and to engage with the stopper body.

21. The system of claim 20, wherein the sleeve is attached to the stopper body via the lip engagement member.

22. The system of claim 20, wherein the at least one clamp includes a connecting link attached between the lever and the stopper body.

23. The system of claim 22, wherein the at least one clamp includes a lip engaging portion pivotally attached to the connecting link.

24. The system of claim 20, wherein the sleeve is adapted to cover the container and hold a broken glass container in the inner space.

* * * * *